United States Patent [19]

Yamamoto et al.

[11] B 4,006,764

[45] Feb. 8, 1977

[54] PROTECTION CASE FOR TAPE-RECORDER OR RADIO-SET

[75] Inventors: Kozo Yamamoto, Hirakata; Takuro Ibi, Kashiwazaki, both of Japan

[73] Assignee: Matsushita Electric Industrial Co., Ltd., Kadoma, Japan

[22] Filed: Oct. 8, 1974

[21] Appl. No.: 513,134

[44] Published under the second Trial Voluntary Protest Program on March 23, 1976 as document No. B 513,134.

[30] Foreign Application Priority Data

| | | |
|---|---|---|
| Oct. 12, 1973 | Japan | 48-119303[U] |
| Oct. 12, 1973 | Japan | 48-119304[U] |
| Oct. 12, 1973 | Japan | 48-119305[U] |
| Oct. 15, 1973 | Japan | 48-119986[U] |
| Oct. 15, 1973 | Japan | 48-119987[U] |

[52] U.S. Cl. ..... 150/52 R

[51] Int. Cl.[2] ..... B65D 65/06

[58] Field of Search ..... 150/52 R, 52 N, 52 E

[56] References Cited

UNITED STATES PATENTS

| | | | |
|---|---|---|---|
| 2,467,471 | 4/1949 | Goldstein | 150/52 R |
| 3,280,870 | 10/1966 | Bundy | 150/52 R |
| 3,459,870 | 8/1969 | Plummer | 150/52 R |
| 3,589,971 | 6/1971 | Reed | 150/52 R |
| 3,612,233 | 10/1971 | Nagpal | 150/.5 |

FOREIGN PATENTS OR APPLICATIONS

| | | | |
|---|---|---|---|
| 377,714 | 6/1964 | Switzerland | 150/52 R |

*Primary Examiner*—William Price
*Assistant Examiner*—Ro E. Hart
*Attorney, Agent, or Firm*—Cushman, Darby & Cushman

[57] ABSTRACT

This invention relates to protection cases for such portable sonance instruments as tape recorders, radio receiving sets, etc. These cases are made with waterproof sheet material such as vinyl chloride, so as to cover tightly to protect those instruments from water, spray, dust or the like.

1 Claim, 11 Drawing Figures

PROTECTION CASE FOR TAPE-RECORDER OR RADIO-SET

BACKGROUND OF THE INVENTION

Such portable electronic instruments as radio receiving sets, tape recorders, etc. are often carried outdoors such as on fishing, swimming, picnics or excursions, and are used on the sea, shore, river, mountain, field, etc. In such cases, if those instruments get wet or humid by rain, sea or river water or spray or are hit by dust, the electronic circuits, speakers or other devices in the instruments are liable to sustain mechanical and electrical troubles.

Nevertheless, if the instruments are tightly covered with ordinary waterproof fabrics or the like, the sounds from the speakers are screened by the covers, and hence, attenuate. Furthermore such covers obstruct free handling of dials, switches, etc., of the instruments.

SUMMARY OF THE INVENTION

In view of such problems as mentioned above, this invention is purposed to provide convenient containers for protecting portable sonance instruments such as radio receiving sets, tape recorders, etc., from water, its spray or drippings, dust, etc., without deteriorating the sound outputs and without inconveniencing the operational handling of the instruments from outside the containers.

DETAILED DISCLOSURE OF THE INVENTION

Figure 1:
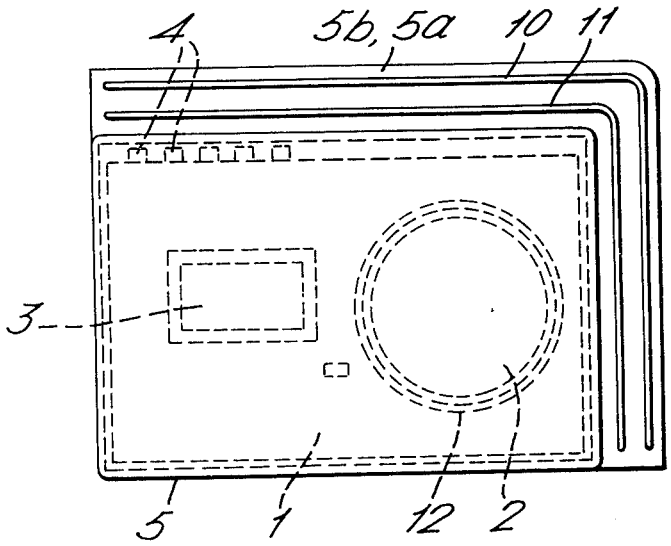
FIG. 1 is a front view of a case embodying this invention in the state of enclosing a tape recorder.
Figure 2:
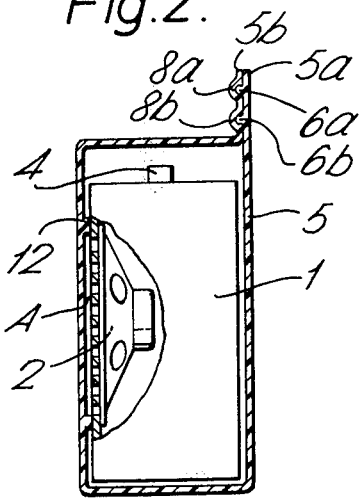
FIG. 2 is a partly fragmental sectional side view of said case.

In the first example shown by FIGS. 1 to 3, numeral 1 indicates a cassette tape recorder exemplifying portable sonance instruments referred to in this invention, numeral 2 a speaker, numeral 3 a cassette setting part, i.e., a magazine for cassette, and numerals 4 — 4 are operational buttons. Numeral 5 indicates a protection case made of a waterproof material such as vinyl chloride, or the like, and formed into a shape of case to fit over said tape recorder 1. The top part and one of the side parts of case 5 and be opened so that the tape recorder 1 can be freely inserted and taken out.

Numerals 5*a* and 5*b* designate a pair of flanges rising from the opening, each flanges of the pair touching each other, face to face, one flanges of which has a parallel pair of protruding ribs 6*a* and 6*b* with a section of a round part on a narrow base part.

Figure 3A:
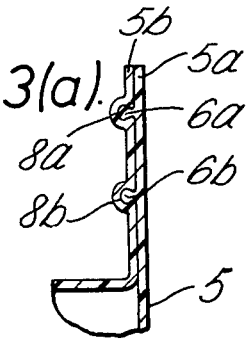
FIGS. 3*a* and 3*b* are enlarged sectional side views of zippers of said case.
Figure 3B:
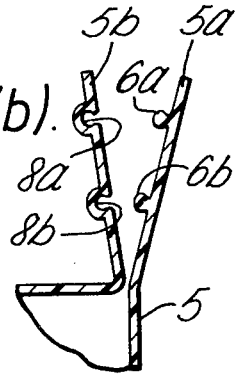

The opposite flanges has a parallel pair of indented grooves 8*a* and 8*b* whose opening widths are narrower than the bottom part thereof. The protruding ribs 6*a* and 6*b* and grooves 8*a* and 8*b*, respectively, are engaged to each other in air and watertight relation by pressing both flanges together, thereby forming a pair of plastic zippers 10 and 11 of a known kind. In other words, as shown in FIG. 3*a*, by pressing the hems 5*a* and 5*b* together, the protruding ribs 6*a* and 6*b* of the zippers 10 and 11 fit into the dented grooves 8*a* and 8*b* completely airtight by the flexible property of plastics. By pulling the flanges 5*a* and 5*b* apart, the zippers 10 and 11 are disengaged as shown in FIG. 3*b* and the protection case 5 opens.

Numeral 12 indicates a ring-shaped protrusion provided on the inner face of the case 5 in a position to meet with a circumferential rim of the speaker 2 of the tape recorder 1 enclosed in the protection case 5. By this protruding ring 12, a space A is created between the inner face of the protection case 5 and a net or lattice part in front of the speaker 2 of the tape recorder 1 enclosed in the protection case 5.

Being constituted in the above-mentioned manner, once the tape recorder 1 is put in the opened protection case 5 and then its zippers 10 and 11 are fastened by pressing them together, the tape recorder 1 is now completely airtightly and watertightly sealed and protected inside the case 5. Therefore, even if such package is used on the sea or other spraying places, there is no fear of spray infiltrating into the instrument and causing rust, etc. Moreover, the airtight characteristic of the protection case prevents dust infiltration and helps to maintain the normal performance of the instrument. Especially for a tape recorder, the case protects its magnetic heads, etc. from such effects as corrosion, etc. by toxic gases.

Since the space A is provided between the inner face of the protection case 5 and the speaker 2, sounds from the speaker 2 are prevented from making unpleasant vibratory noise to occur from undesirable contacts between the net or lattice in front of speaker 2 and the inner face of the case 5.

Figure 4:
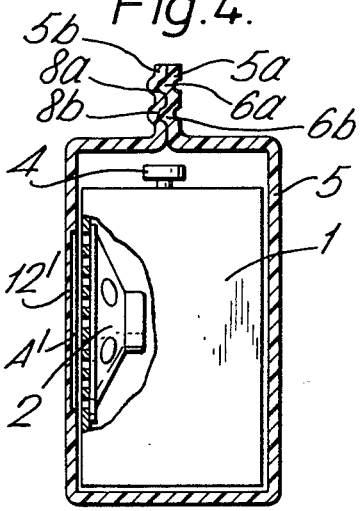
FIG. 4 is a partly fragmental sectional side view of another example of this invention.

FIG. 4 shows another example of this invention. In each ixample to be explained hereafter, the parts corresponding to those mentioned in FIG. 1 to FIG. 3 will be referred to by the same symbols and numerals and the foregoing explanation will apply. In this example 4, the part on the inner face of the protection case 5 facing the speaker 2 of the tape recorder 1 is thinned inward, but level flat outside forming a thinly layered sound area 12′ in front of the speaker 2. Thus a space A′ is created between the speaker 2 and the inner face of the case 5 when the tape recorder 1 is enclosed.

Owing to this space A′ the vibratory noise is prevented for the aforementioned reason. Furthermore the thinly layered area in front of the speaker 2 makes the sound transmission better and minimizes the loss of sound.

Figure 6:
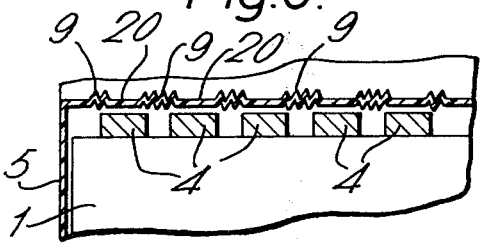
FIG. 6 is a partly fragmentsl enlarged front view, namely a sectional view at b—b′ plane of the example shown in FIG. 5.
Figure 5:
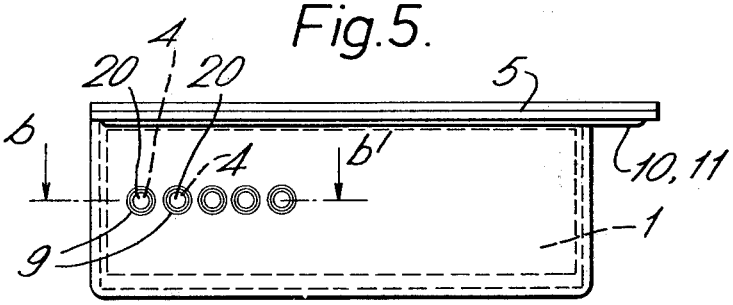
FIG. 5 is a plan view of still another example of this invention.

FIG. 5 and 6 shows still another example of this invention wherein the parts of the case 5 facing the operational buttons 4 — 4 of the tape recorder 1 are made into soft constitutions so as to enable the operation of buttons from outside the case 5. Numerals 9 — 9 indicate sound bellows formed on the case 5 in such positions as to concentrically cover over operational buttons 4 — 4, respectively, of the tape recorder 1.

When centers 20 — 20 of the bellows 9 — 9 are pushed down by fingers, the bellows 9 — 9 stretch, and thereby, their centers 20 — 20 touch the operational buttons 4 — 4, and when further pushed down, the operational buttons 4 — 4 are also pushed down to make the tape recorder 1 perform the operation of recording, reproduction, winding-back or the like. Therefore, it is not necessary to open the flanges 5*a* and 5*b* of the protection case 5 for performing each operation of the tape recorder when using it in wet or dusty places. Consequently, the tape recorder is protected from spray and dust, and as a result, the tape recorder can be kept free from functional deterioration or trouble.

Figure 7:
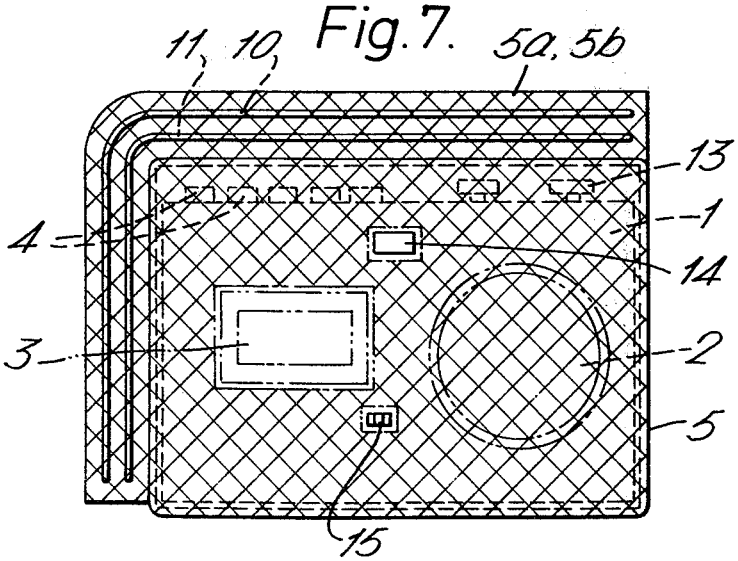
FIG. 7 is a front view of still another example of this invention.
Figure 8:
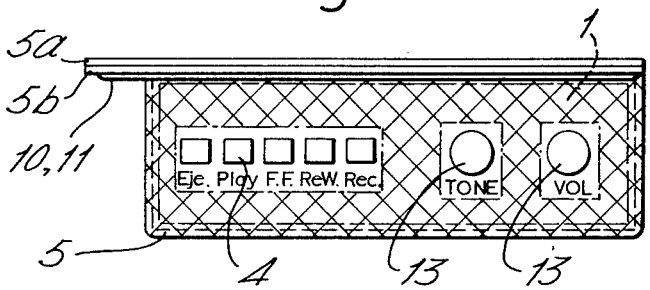
FIG. 8 is a plan view of the preceding example.

In examples of FIGS. 7 and 8, parts on the protection case 5 necessary for operations of enclosed instrument are made transparent and the other parts are made of an opaque and more durable, waterproof sheet material such as vinyl chloride so as to improve the life of the case 5, and at the same time, to facilitate easy operation of the instrument. In other words, on protection case 5, important parts, through which parts important controlling and indicating parts are to be seen, are made transparent in a window fashion. Other parts are made of sufficiently durable opaque synthetic resins. For instance, on the protection case, parts corresponding to the cassette magazine 3, tape driving control knobs 4, 4 —, sound volume and tone control knobs 13,13—, signal level meter 14, tape length counter 15, etc., are made transparent.

As explained above, since the parts of the protection case 5 facing the essential parts for operating the tape recorder 1 are made transparent, it can be easily discerned from outside the protection case 5 whether the tape recorder 1 inside is working correctly as intended for or not. Moreover, since the locations of functional parts concerned are clearly visible from outside the protection case 5, it is easy to decide which part of the zippers 10 and 11 is to be opened for making switch-over or adjustment of the operation or for regulating the sound. On the other hand, by forming the other part, namely the major part, of the protection case 5 with opaque materials, it is possible to improve greatly the strength and durabity of the case through the use of a synthetic resin made opaque with addition of reinforcing additives, etc.

Figure 9:
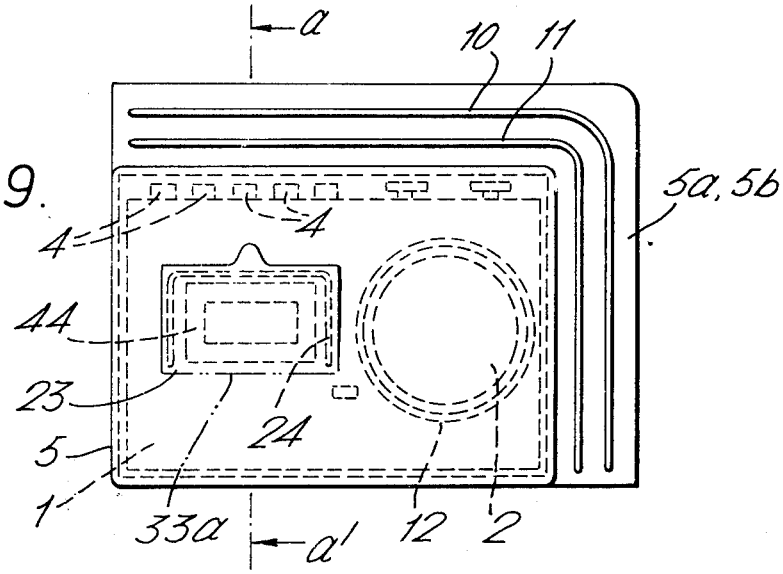
FIG. 9 is a front view of still another example of this invention.
Figure 10:
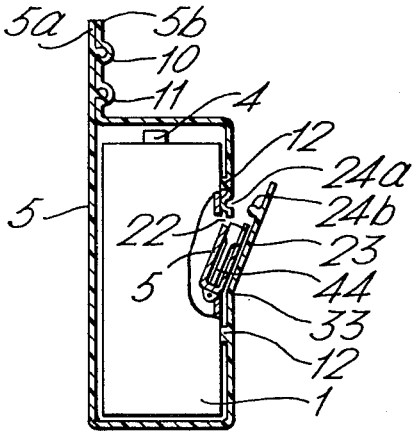
FIG. 10 is a partly fragmental side view of the section made by a—a′ plane of the example shown in FIG. 9.

An example in FIGS. 9 and 10 show a further modified protection case. Besides being an airtight, waterproof and dustproof case of synthetic resin, this model features that a recording tape cassetee 44 can be inserted or removed to or from the cassette magazine 3 of a tape recorder enclosed in this type of protection case without taking out the tape recorder from the case 5.

In FIGS. 9 and 10, numeral 22 indicates an opening formed in the part of protection case 5 corresponding to a magazine 3 for recording tape cassette 44 and numeral 23 indicates a lid for closing opening 22 and constituting a part of said protection case 5. This lid 23 has a slightly larger area than opening 22 and its bottom line constitutes a straight hinge 33 easily openable and closable by the elastic property of plastics. Along the flange of this lid 23 and the edge of opening 22 where they overlap each other a zipper 24 of the same kind as aforementioned zippers 10 and 11 is provided; namely, along the edge of the opening 22, a dented groove 24*a* is formed, and along the flange of the lid 23, a protruding rib 24*b* to fit into dented groove 24*a* is formed, and by engaging said protruding range 24*b* into the dented groove 24*a*, the opening 22 is air and water tight closed.

On account of the above-mentioned constitution, the recording tape cassette 44 can be easily inserted or removed in or from the magazine 3 without taking out the tape recorder 1 from the protection case 5. Therefore, this case is suitable for the use in wet or dusty places without a fear for the tape recorder 1 to be damaged or functionally deteriorated by spray or dust.

What is claimed is:

1. A protection case for an audio instrument and operational controls, having speakers, said case being formed of waterproof sheet material in a shape roughly conforming to the shape of said instrument, said case having a first opening through which said instrument can be inserted and taken out, with plastic engaging portions on opposing surfaces adjacent said first opening to form a zipper for closing said opening in air and water tight relation with said instrument therein, said case further having a region of reduced thickness on the inner surface thereof so as to form an air space between said speaker and said case, said case further having a plurality of flexible bellows adjacent said control for operating said controls by manually flexing said bellows, said case further having transparent and opaque portions with the transparent portions being located so as to permit viewing from outside of the operation of said instrument, and said case having a further opening for inserting a cassette into said case with engaging portions of opposing surfaces adjacent said further opening to form a zipper for closing said further opening in air and water tight relation with said instrument therein.

* * * * *